US005401217A

United States Patent [19]

Rodriguez-Ferre

[11] Patent Number: 5,401,217

[45] Date of Patent: Mar. 28, 1995

[54] PORTABLE BOWLING GAME AND CARRYING CASE

[76] Inventor: José M. Rodriguez-Ferre, Polg. Industrial Derramador, Albacete s/. - 03440-IBI (Alicante), Spain

[21] Appl. No.: 159,361

[22] Filed: Nov. 30, 1993

[51] Int. Cl.[6] ..... A63D 1/02

[52] U.S. Cl. ..... 473/54; 473/116

[58] Field of Search ..... 473/54, 55, 103, 113, 473/116; 446/71; 206/315.1

[56] References Cited

U.S. PATENT DOCUMENTS 654,063 6/1900 Haskell ..... 473/116
1,360,661 11/1920 Malone ..... 473/116
1,623,518 4/1927 Allen ..... 473/116
3,059,924 10/1962 Brown ..... 473/116

*Primary Examiner*—V. Millin
*Assistant Examiner*—William M. Pierce

[57] ABSTRACT

A children's bowling game having two bases (2), with a channel (13) for the bowling balls (6). Between the bases there is located a board (1) acting as a lane for the bowling pins (5). The bases each include a scoreboard (3). When the game is dismantled, said bases form a container for the remaining parts of the game, which may be carried by a handle (14).

10 Claims, 1 Drawing Sheet

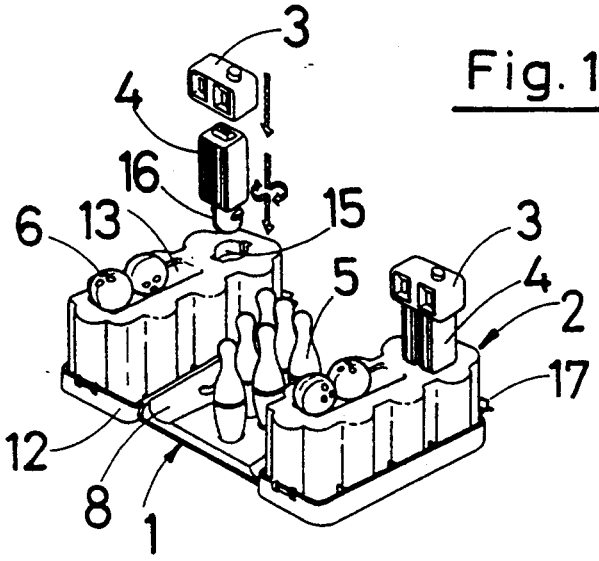
Fig. 1
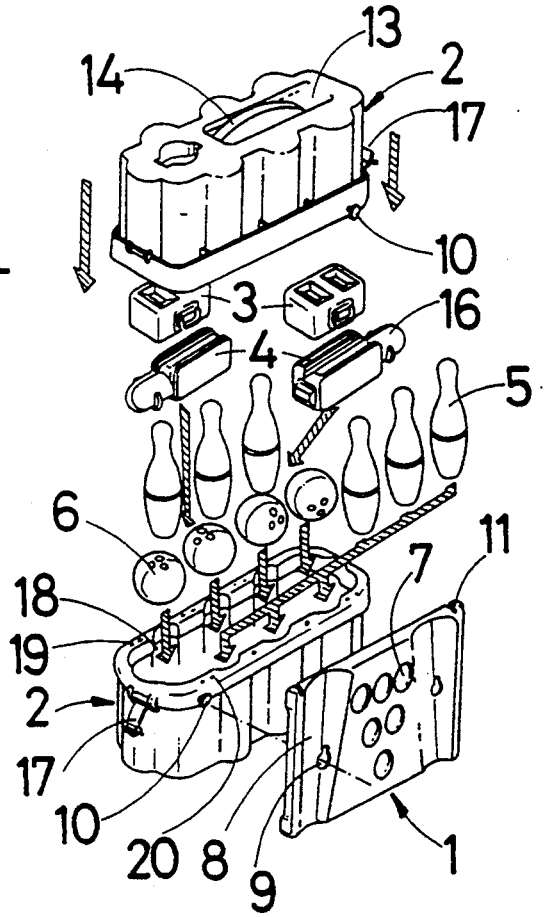
Fig. 2
Fig. 3
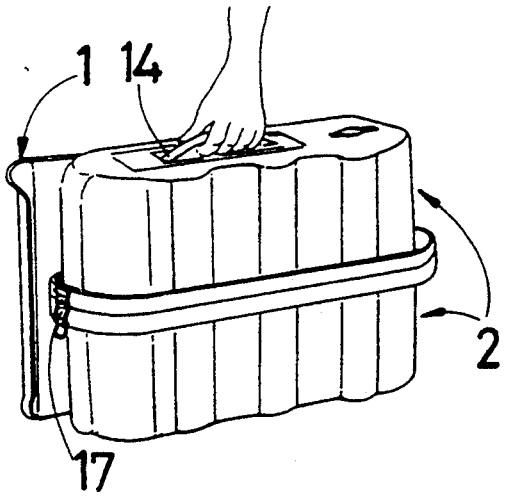

PORTABLE BOWLING GAME AND CARRYING CASE

BACKGROUND OF THE INVENTION

The present invention relates to a children's bowling game.

SUMMARY OF THE INVENTION

In the invention there has been devised a bowling game particularly for children over three years of age, formed by a plurality of parts made from moulded material, each of which forms a particular component of the game, such as a lane for positioning the bowling pins, the bowling pins themselves, bowl collecting gutters, scoreboard and the bowls with finger holes. The above described components include means for associating them to form the game set, which may be easily installed by the child himself and be used either indoors or outdoors.

The game may also be easily dismantled and certain components thereof form a shell in which the remaining components are housed, providing a compact, suitcase-like unit with a handle, for carriage by the child himself.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a perspective view of the bowling game comprising the various components duly coupled together.

FIG. 2 illustrates the arrangement of the various components to form an easily transportable suitcase-like unit.

FIG. 3 illustrates the suitcase unit after closing, ready for being carried.

DETAILED DESCRIPTION OF THE PREFERRED EMBODIMENT

In the drawings, there is to be seen an embodiment of a bowling game comprising a plurality of moulded material parts, listed below:

A board 1, forming the bowling pin support lane.

Two bases 2, forming the gutters for the bowling balls and which when joined together by the bottoms form a carrying case for the dismantled game.

Scoreboards 3 and the respective supports 4 thereof.

Bowling pins 5.

The board 1 is provided with circular depressions 7 for positioning the bowling pins 5 and gutters 8, on both sides, for returning the bowling balls 6. In the gutters there are provided radially slotted orifices 9 for receiving the studs 10 of the bases in the game carrying position. The edges of the board 1 are slotted in 11 for riding on the turned edges 12 of the bases 2 in the functional position of the game.

The bases 2 are hollow and are open at the bottom end thereof, while the upper end is provided with a channel 13 for containing the bowling balls 6 and a handle 14 for carrying the dismantled game set. Both bases engage each other by the open ends thereof, forming a container for the game components, except for the board 1, which engages with the studs 10, by way of the orifices 9, on the outside. The bases are held together by latch-type closures 17 in combination with studs 19 and recesses 20.

The top ends of the bases 2 are provided with openings 15 for receiving the axial pins 16 of the prismatic supports 4 of the scoreboards 3. The scoreboards 3 shown in FIG. 1 include a knob, not numbered, for rotating the number indicators.

The walls of the bases 2 are provided with half round cavities 18 for locating the bowling pins 5.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A children's bowling game, comprising a plurality of independent parts including:

a plurality of bowling pins;

at least one bowling ball;

a board forming a support lane for said bowling pins;

a pair of bases adapted to be placed at opposite sides of said board, each of said bases also being provided at a top end with a channel for holding said bowling balls and an opening; and a pair of scoreboards provided with supports having an axial pin for insertion in said openings of said bases.

2. The children's bowling game of claim 8, wherein each of said bases are configured as a generally rectangular box open on a lower support side around which there is formed an outwardly turned edge, said edge forming a flat plane for facilitating the engagement of said open sides of both bases to form a container for housing the remaining game parts, with the exception of the board.

3. The children's bowling game of claim 2, characterized in that said flat planes of the edges are provided with alternate male pins and recesses, to form a stable tongue and groove engagement consolidated with a closure.

4. The children's bowling game of claim 2 characterized in that the edges are provided on an outer side thereof with round-headed bosses for insertion in radially slotted orifices formed in the board, for association of the latter with the container block formed by both bases.

5. The children's bowling game of claim 2 characterized in that the upper side of at least one of the bases includes a handle for carrying the container formed by said bases.

6. The children's bowling game of claim 1 characterized in that the board is provided in a center region thereof with reference depressions for locating the bowling pins and at both sides of said center region with return gutters for the bowling balls.

7. The children's bowling game of claim 1 characterized in that at the ends of the board there are slots for riding over an outer edge of the edges of said bases in a functional position of the game.

8. A children's bowling game, comprising a plurality of independent parts including:

a plurality of bowling pins;

at least one bowling ball;

a board forming a support lane for said bowling pins; and a pair of bases adapted to be placed at opposite sides of said board, each of said bases also being provided at a top end with a channel for holding said bowling balls, each of said bases are configured generally as a rectangular box open on a lower support side and wherein engagement of said open sides of both bases form a container for housing the remaining game parts, with the exception of the board.

9. The children's bowling game of claim 8 characterized in that the board is provided in a center region thereof with reference depressions for locating the bowling pins and at both sides of said center region with return gutters for the bowling balls.

10. The children's bowling game of claim 8 characterized in that the upper side of at least one of the bases includes a handle for carrying the container formed by said bases.

* * * * *